US006834405B1

(12) United States Patent
Hillstead

(10) Patent No.: US 6,834,405 B1
(45) Date of Patent: Dec. 28, 2004

(54) MECHANISM FOR SECURING AN INFANT IN THE SUPINE POSITION

(76) Inventor: Edward Allen Hillstead, 600 Sharon Park Dr., Apt. C203, Menlo Park, CA (US) 94025

( * ) Notice: Subject to any disclaimer, the term of this patent is extended or adjusted under 35 U.S.C. 154(b) by 0 days.

(21) Appl. No.: 10/419,287

(22) Filed: Apr. 18, 2003

Related U.S. Application Data

(60) Provisional application No. 60/373,969, filed on Apr. 19, 2002.

(51) Int. Cl.[7] ..... A47D 15/00; A62B 35/00; A47G 9/04

(52) U.S. Cl. ..... 5/655; 5/494; 5/496; 5/498; 5/922; 128/872

(58) Field of Search ..... 5/655, 482, 494, 5/496, 498, 499, 500, 502, 922, 923; 2/69.5, 69; 128/872, 873

(56) References Cited

U.S. PATENT DOCUMENTS

| | | | | | |
|---|---|---|---|---|---|
| 1,964,271 | A | * | 6/1934 | O'Dwyer | 128/873 |
| 2,342,069 | A | * | 2/1944 | Wilkinson | 128/872 |
| 2,419,989 | A | * | 5/1947 | Day | 2/114 |
| 2,423,392 | A | * | 7/1947 | Krogh | 128/873 |
| 2,481,741 | A | * | 9/1949 | Graves | 128/873 |
| 2,503,427 | A | * | 4/1950 | Waterworth | 128/873 |
| 2,563,501 | A | * | 8/1951 | Sperling | 128/872 |
| 2,589,708 | A | * | 3/1952 | Koster | 128/873 |
| 2,758,595 | A | * | 8/1956 | Lovett | 5/655 |
| 2,940,443 | A | * | 6/1960 | Baker | 128/874 |
| 2,989,753 | A | * | 6/1961 | Burner | 2/69.5 |
| 3,521,309 | A | * | 7/1970 | Evans | 5/494 |
| 3,845,513 | A | * | 11/1974 | Hubner | 2/69.5 |
| 3,987,505 | A | * | 10/1976 | Hickey | 2/114 |
| 4,202,052 | A | * | 5/1980 | Bilanzich | 2/69.5 |
| 4,597,121 | A | * | 7/1986 | Bouma | 5/494 |
| 4,858,625 | A | * | 8/1989 | Cramer | 128/872 |
| 4,862,535 | A | * | 9/1989 | Roberts | 5/655 |
| 4,989,286 | A | * | 2/1991 | Tucker | 5/482 |
| 5,208,925 | A | * | 5/1993 | Edlund | 5/424 |
| 5,233,714 | A | * | 8/1993 | De Bell Daniel | 5/655 |
| 5,400,803 | A | * | 3/1995 | Vines | 128/872 |
| 5,439,008 | A | * | 8/1995 | Bowman | 128/875 |
| 5,746,219 | A | * | 5/1998 | McConnell | 128/845 |
| 6,381,785 | B1 | * | 5/2002 | Mancera Browne et al. | 5/655 |
| 6,631,528 | B2 | * | 10/2003 | Landry | 5/494 |
| 6,681,422 | B2 | * | 1/2004 | Landry | 5/494 |
| 6,708,356 | B1 | * | 3/2004 | LaValle | 5/655 |
| 2003/0154548 | A1 | * | 8/2003 | Landry | 5/494 |
| 2003/0154549 | A1 | * | 8/2003 | Landry | 5/494 |
| 2004/0019970 | A1 | * | 2/2004 | Landry | 5/494 |
| 2004/0045089 | A1 | * | 3/2004 | Zucker et al. | 5/655 |

* cited by examiner

*Primary Examiner*—Robert G. Santos
(74) *Attorney, Agent, or Firm*—Law Offices of Imam

(57) ABSTRACT

A securing mechanism for securing an infant in the supine position includes a supporting pad having a top surface for supporting said infant in the supine position, in accordance with an embodiment of the present invention. The securing mechanism further includes a securing harness for securing said infant to said supporting pad, said securing harness being secured onto said infant's body, said securing harness including a securing pad for covering part of the back side of said infant's body, said securing pad being attached to said top surface of said supporting pad for securing said infant to said top surface of said supporting pad in the supine position.

16 Claims, 9 Drawing Sheets

MECHANISM FOR SECURING AN INFANT IN THE SUPINE POSITION

REFERENCE TO PRIOR APPLICATION

This application claims the benefit of a previously filed U.S. Provisional Application No. 60/373,969 filed on Apr. 19, 2002, and entitled "A MECHANISM FOR SECURING AN INFANT IN THE SUPINE POSITION".

BACKGROUND OF THE INVENTION

1. Field of the Invention

The present invention relates generally to the field of infant safety and particularly to a method and apparatus for securing an infant in the supine position.

2. Description of the Prior Art

The safety of an infant is obviously of prime importance to the parents and caregivers engaged in nursing and raising infants on a daily basis. This is especially significant in modern times as more responsibilities and obligations face working mothers and caregivers entrusted with the care and supervision of infants.

The infants are often positioned on a crib mattress or a bed for extended periods of time for sleeping, playing, or feeding. It is important in the early stages of the infant's development that the infant remain in the supine position when left unsupervised or unattended. In the event the infant rolls over on the prone position the risk of Sudden Infant Death Syndrome (SIDS) becomes significant. One possible unfortunate consequence of SIDS is death by suffocation due to lack of oxygen reaching the infant facing down on the crib mattress. Rolling over has other hazards for the infant such as falling from a raised bed to the floor due to lack of protective supports around the bed.

According to the American Academy of Pediatrics (AAP), in the early 1990's SIDS claimed the lives of 6000–7000 infants each year in the US. Research has demonstrated that supine sleep position reduces SIDS by 20–67%. The prone position has a 3–9 times greater risk of SIDS than the supine position. In 1992 the AAP recommended that all healthy infants be positioned in the supine position or on their sides while sleeping for the first 6 months of life. In 1996 the AAP further stated that the supine sleep position is preferred over the side sleep position. Since the implementation of these recommendations, national data reveals a 40% decrease in the SIDS rate. More specifically, a study in Seattle demonstrated a 50% decline in SIDS following an intensive sleeping-on-the-back campaign. In March of 2002, the AAP reaffirmed its recommendation that all healthy infants be placed in the supine sleep position.

Although the SIDS rate decreased in the US, it still remains a formidable cause of infant death: SIDS is the highest cause of infant death beyond the neonatal period. Despite great efforts to educate parents and caregivers, the recommendations for supine position fall short of complete compliance. The March 2000 AAP policy statement on SIDS revealed that nearly 20% of caregivers switch from placing infants on their backs to their stomachs between 1 and 3 months old, the peak age range for SIDS. A study published in the September issue of Pediatrics reviewing death-scene information of 119 infant deaths diagnosed as SIDS revealed that more than 60% of the dead infants were found on their stomachs. In addition, according to a study published in the August 2000 issue of the Pediatrics, a significant portion of SIDS deaths occur in child care settings: the study found that infants in child care settings were more likely to be put to sleep on their stomachs or to be found sleeping on their stomachs.

In light of the above-mentioned, it is desirable to develop a means and apparatus for securing the infant in the supine position for extended periods of time without requiring constant supervision. It is also desirable that the infant's mobility not be hindered while secured in the supine position.

SUMMARY OF THE INVENTION

Briefly, an embodiment of the present invention includes a securing mechanism for securing an infant in the supine position. The securing mechanism includes a supporting pad having a top surface for supporting said infant in the supine position. The securing mechanism further includes a securing harness for securing said infant to said supporting pad, said securing harness being secured onto said infant's body, said securing harness including a securing pad for covering part of the back side of said infant's body, said securing pad being attached to said top surface of said supporting pad for securing said infant to said top surface of said supporting pad in the supine position.

The foregoing and other objects, features, and advantages of the present invention will be apparent from the following detailed description of the preferred embodiments which make reference to several figures of the drawing.

IN THE DRAWINGS

FIG. 6(*b*) shows the backside of a fastened securing harness, according to an embodiment of the present invention.

DETAILED DESCRIPTION OF THE PREFERRED EMBODIMENTS

Figure 1:
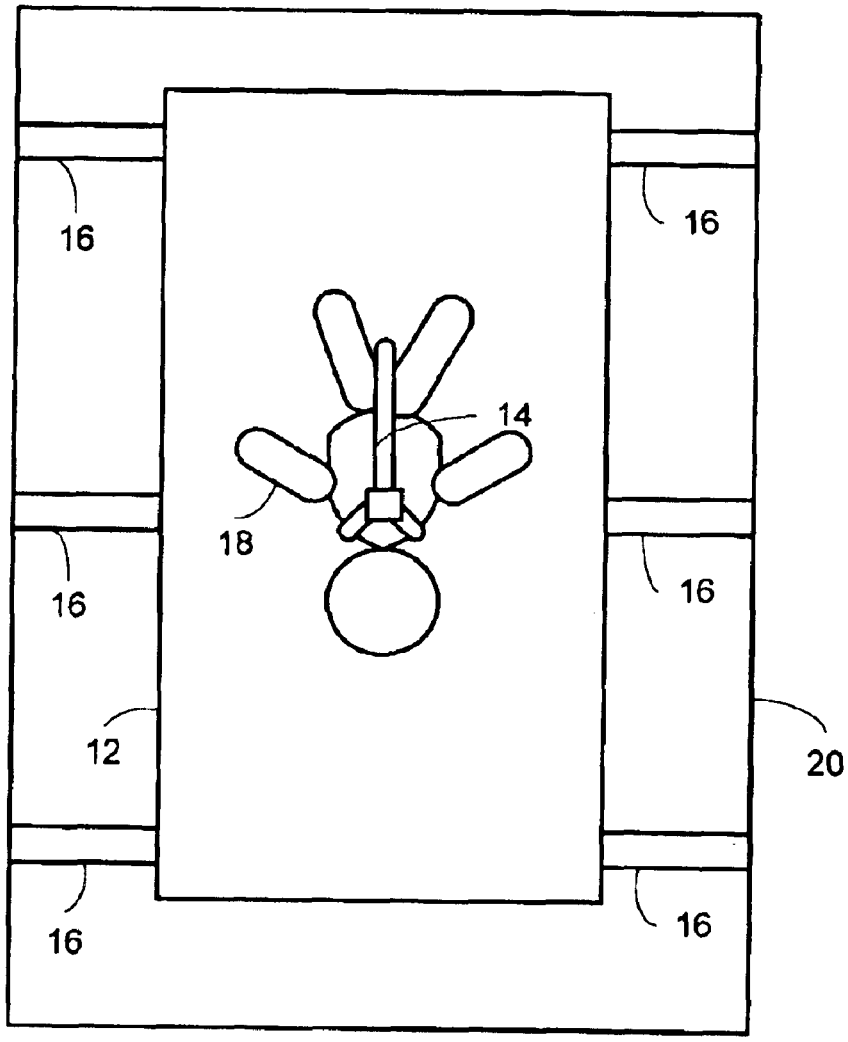
FIG. 1 shows a front view of an infant with the securing mechanism, according to an embodiment of the present invention.

Referring now to FIG. 1, a front view of an infant with a securing mechanism is shown, in accordance with an embodiment of the present invention. The securing mechanism shown in FIG. 1 includes a supporting pad 12 and a securing harness 14. Also shown in FIG. 1 are an infant 18 and a mattress 20. The mattress 20 is part of a bed wherein infant 18 is placed for rest and/or sleep. The infant 18 is secured to the supporting pad 12 by the securing harness 14. The securing harness 14 is secured to the infant 18 via an adjustable fastener and the infant 18 is secured to the mattress 20, as described in more detail hereinbelow.

The securing mechanism is placed on a supporting surface and attached to supporting structures via an attaching mechanism. The attaching mechanism may be safety pins, buttons, tic strings, etc. In the embodiment of the present invention shown in FIG. 1, the attaching mechanism comprises a plurality of support straps 16 (six are shown in FIG. 1) that secure the supporting pad 12 to the mattress 20. The securing surface may be any soft or cushioned surface whereupon the supporting pad 12 is placed. The supporting structures may be any structure to which the supporting pad 12 is securely attached. In the embodiment of the present invention shown in FIG. 1, the supporting surface is the mattress 20 and the supporting structures are the solid parts of the bed therein the infant 18 is placed.

The support straps 16 are attached to the supporting pad 12 on one end and to the solid parts of the bed (not shown in FIG. 1) on the other end. The back-side of the securing harness 14 is attached to the supporting pad 12 thereby securing the infant 18 to the mattress 20, as described in more detail hereinbelow. In an alternative embodiment of the present invention the support straps 16 are wrapped around the mattress 20 and connected in pairs on the underside of the mattress 20 to secure the supporting pad 12 to the mattress 20.

The securing mechanism secures the infant 18 to the supporting pad 12 via the securing harness 14. The securing harness 14 passes over the shoulders and between the legs of the infant 18 and is secured to the front of the infant 18 via an adjustable fastener, as described in more detail hereinbelow. As a result, the infant 18 is held in the supine position on the mattress 20. Accordingly, the present invention allows the infant 18 to be left in the supine position without supervision thereby minimizing the risk of suffocation and other hazards caused by rolling of the infant.

Sudden infant death syndrome (SIDS) results if an infant, originally placed in the supine position, rolls over to a new position facing the supporting surface, e.g. the mattress, and develops breathing problems that may lead to suffocation. The embodiment of the present invention shown in FIG. 1 minimizes occurrence of infant being in the prone position, a significant risk factor for SIDS, by securing the infant 18 in the supine position without requiring constant supervision. However, it is advised that the present invention not be used on infants with gastroesophageal reflex complications, infants with upper airway birth defects, or premature babies with respiratory compromise.

Figure 2:
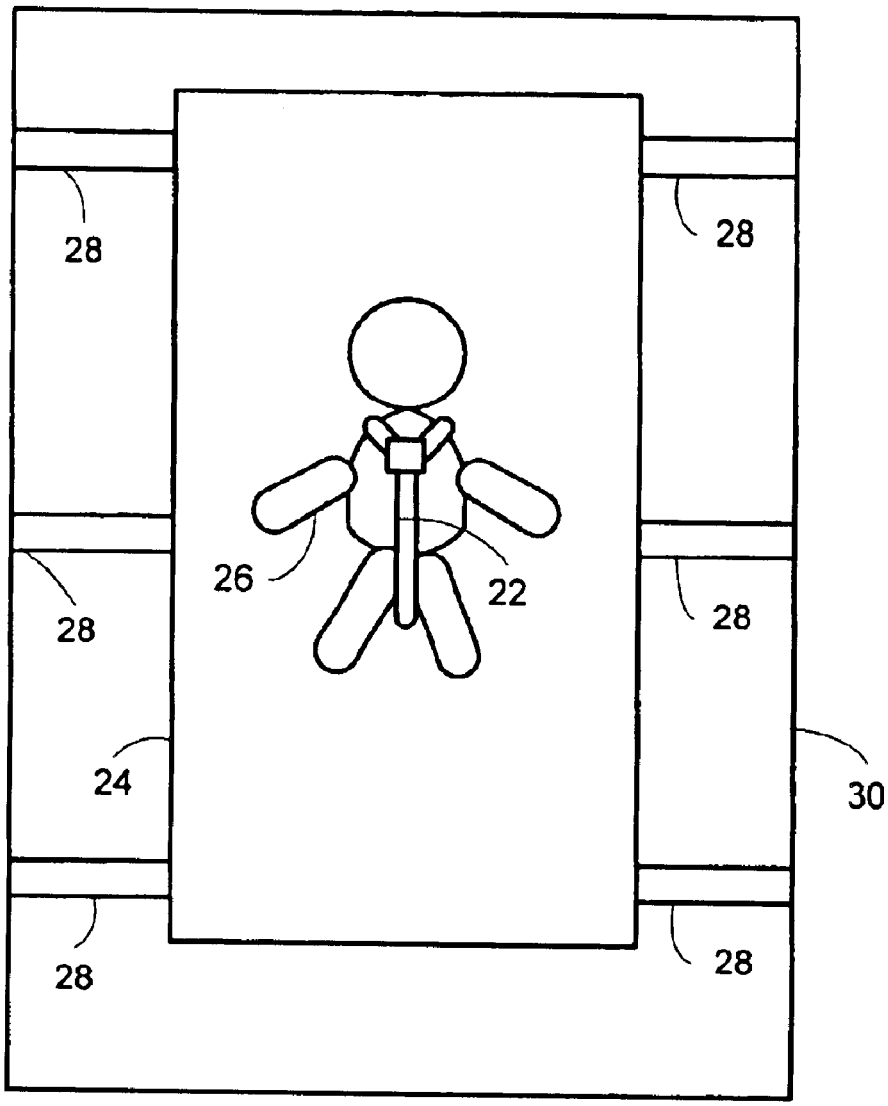
FIG. 2 shows an alternate front view of an infant with the securing mechanism, according to an embodiment of the present invention.

Referring now to FIG. 2, an alternate front view of an infant 26 with a securing mechanism is shown, in accordance with an embodiment of the present invention. The securing mechanism includes a securing harness 22 and a supporting pad 24. Also shown in FIG. 2 are six support straps 28 and a mattress 30.

The securing harness 22 passes over the shoulders and between the legs of the infant 26 and is secured to the infant via an adjustable fastener. On the backside of the infant, the securing harness 22 is attached to the top surface of the supporting pad 24 thereby securing the infant 26 to the supporting pad 24. The bottom surface of the supporting pad 24 is positioned on top of the supporting surface, e.g. a mattress. The mattress is part of a bed wherein the infant 26 is placed for rest and/or sleep. Each of the support straps 28 has a first end and a second end. The first ends of the support straps 28 are attached to the supporting pad 24 and the second ends of the support straps 28 are connected in pairs with adjustable fasteners on the underside of the supporting surface. Accordingly, the securing mechanism secures the infant 26 to the mattress 30 in the supine position. The present invention, therefore, minimizes occurrence of infants being in the prone position, a significant risk factor for SIDS, and protects the infant 26 from dangers that may result if the infant assumes positions other than the supine position.

Figure 3:
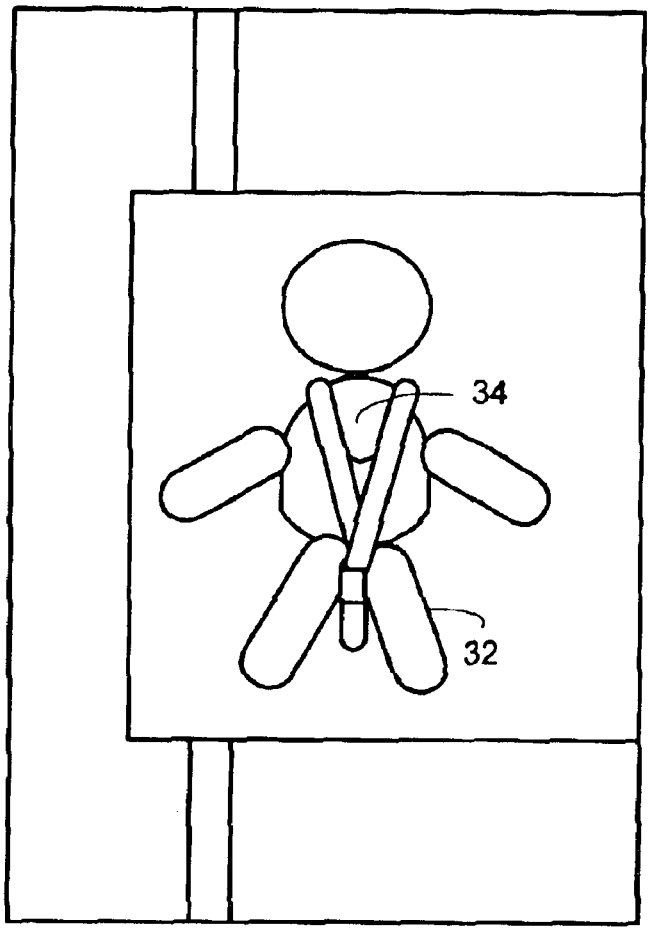
FIG. 3 shows a back view of an infant with the securing harness, according to an embodiment of the present invention.

Referring now to FIG. 3, a back view of an infant 32 with a securing harness is shown, in accordance with an embodiment of the present invention. The securing harness 34 is secured to the infant 32 via an adjustable fastener. The securing harness 34 is made of a flexible, elastic, and soft material such as a stretchable fabric or an elastic band.

In one embodiment of the present invention, the securing harness 34 includes a securing pad having a first and a second surface. The first surface of the securing pad covers part of the back of the infant 32. The second surface of the securing pad is a Velcro surface. A corresponding Velcro patch of comparable size is attached to the supporting pad of the securing mechanism. When the second surface of the securing pad is positioned on the supporting pad, the Velcro surface of the securing pad adheres to the Velcro patch on the supporting pad thereby securing the infant 32 to the supporting pad in the supine position.

Figure 4:
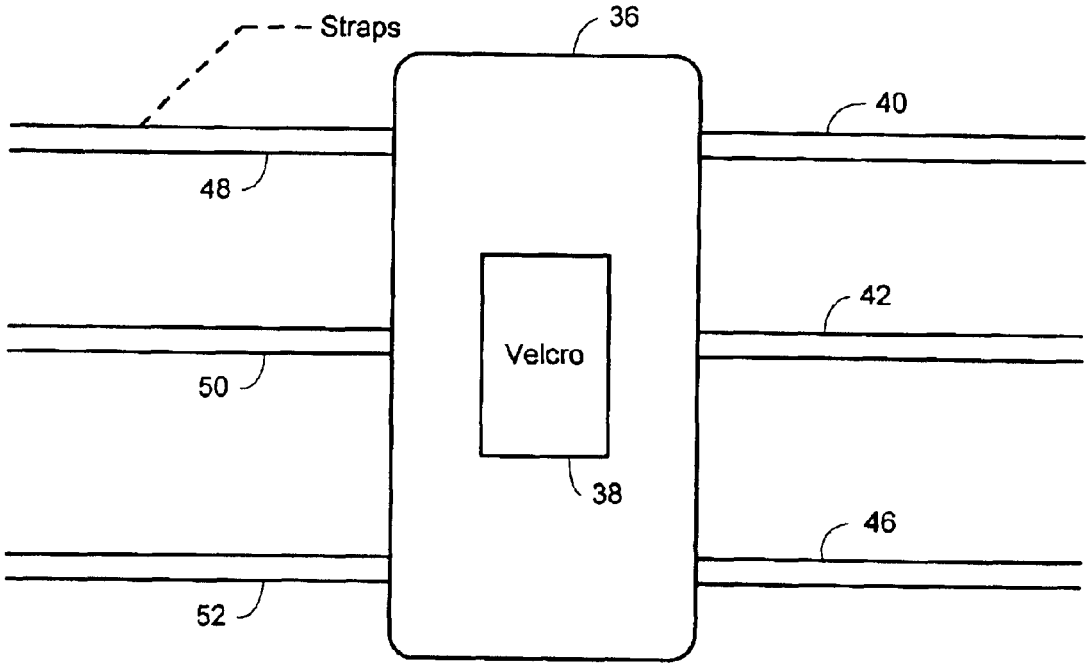
FIG. 4 shows a supporting pad, according to an embodiment of the present invention.

Referring now to FIG. 4, a supporting pad 36 is shown in accordance with an embodiment of the present invention. Also shown in FIG. 4 are a plurality of support straps 40–52 and a Velcro patch 38. The Velcro patch 38 is attached to the supporting pad 36. The first end of each of the six support straps 40–52 is attached to the supporting pad 36. The second ends of the support straps 40–52 connect in pairs with adjustable fasteners on the underside of the mattress.

The supporting pad 36 is made from a soft material such as cotton and may have any shape to cover essentially the entire back of the infant. In the embodiment of the present invention shown in FIG. 4, the supporting pad 36 is rectangular in shape with a rectangular Velcro patch 38 attached thereto. The supporting pad 36 is positioned on top of a supporting surface such as a mattress with the Velcro patch 38 being exposed, as shown in FIG. 4. While wearing the securing harness, the infant is positioned on the top surface of the supporting pad 36 such that the Velcro surface of the securing harness 34 (shown in FIG. 3) adheres to the Velcro patch 38. As a result, the infant is secured to the supporting surface, such as a mattress, in the supine position.

Figure 5:
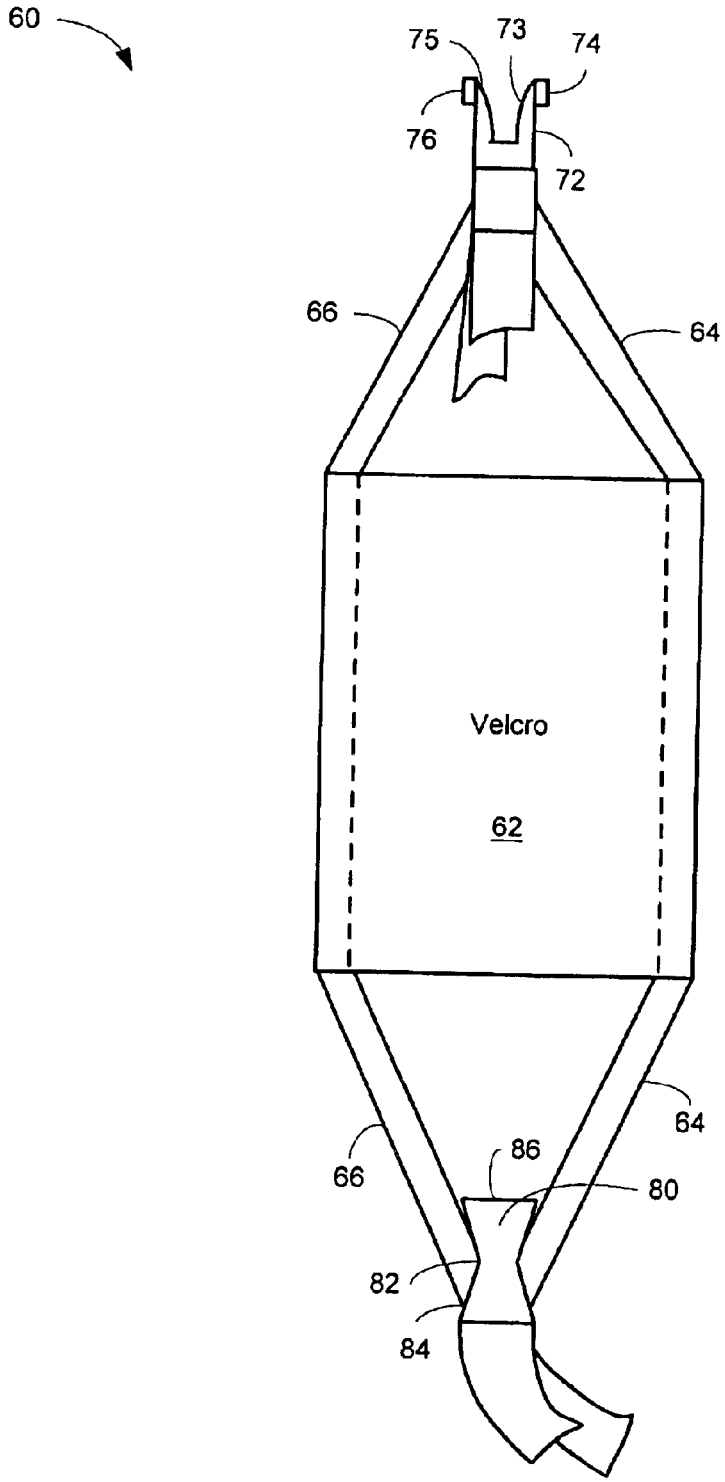
FIG. 5 shows a back view of a securing harness, according to an embodiment of the present invention.

Referring now to FIG. 5, a back view of a securing harness 60 is shown to include a Velcro surface 62 and two lateral harness straps 64 and 66, in accordance with an embodiment of the present invention. Also shown in FIG. 5 are two pieces of an adjustable fastener: a male piece 72 and a female piece 80. The Velcro surface 62 is attached to the lateral harness straps 64 and 66. In the embodiment of the present invention shown in FIG. 5, the lateral harness straps 64 and 66 are sewn to the Velcro surface 62. Each of the straps 64 and 66 has a first end and a second end. The first ends of the lateral harness straps 64 and 66 are connected to the male piece 72 while the second end of each of the straps 64 and 66 is connected to the female piece 80.

The securing harness 60 is secured to the infant such that the first ends of the straps 64 and 66, connected to the male piece 72, pass over the shoulders of the infant while the second ends of the straps 64 and 66, connected to the female piece 80, pass between the legs of the infant. Once secured onto the infant, the Velcro surface 62 faces away from the back of the infant. On the infant's front, the male piece 72 is inserted into the female piece 80 thereby fastening the securing harness 60 to the infant's body. While wearing the securing harness 60, the infant is positioned on the top surface of the supporting pad in such a way that the Velcro surface 62 adheres to the Velcro patch on the supporting pad. The supporting pad may be secured to the structural supports to hold the infant in the supine position.

The ends of the straps 64 and 66 may be fastened using a variety of adjustable fasteners. In the embodiment of the present invention shown in FIG. 5 the male piece 72 includes a first slot and a second slot. The first ends of the straps 64 and 66 are secured to the male piece 72 by being passed through the first slot on the male piece 72, folded, and then passed through the second slot on the male piece 72. The lateral harness straps 64 and 66 are made from a flexible, elastic material such as a stretchable fabric or an elastic band. The length of the straps 64 and 66 may be decreased or increased by pushing the first ends of the straps through the first slot and pulling the first ends of the straps through the second slot. Accordingly, the length of the securing harness may be adjusted to accommodate infants of varying body length.

Similarly, the second ends of the straps 64 and 66 are secured to the female piece 80 through a first and a second slot in the lower part 84 of the female piece 80. In a similar vein, the length of the straps 64 and 66 may be adjusted using the first and second slots on the lower part 84 of the female piece 80, as described hereinabove.

To fasten the securing harness 60 unto the infant, the male piece 72 is inserted into the upper part 86 of the female piece 80 on the front side of the infant. The middle part 82 of the female piece 80 has no lateral walls. The upper part of the male piece 72 includes two flexible arms 73 and 75, each having a protruding segment 74 and 76, respectively, near the tip of the arm. The arms being made of an elastic material, such as a polymeric material, are pressed together (e.g. using two fingers) to decrease the separation therebetween while being inserted into the upper part 86 of the female piece 80. The middle part 82 of the female piece 80 has no lateral walls so that upon reaching the middle part 82 the arms 73 and 75 move farther away from each other to release the tension. As a result, the protruding segments of the arms 74 and 76 protrude out of the lateral sides of the middle part 82 and rest against the lateral walls of the upper part 86 and the lower part 84 thereby locking the male piece 72 in the female piece 80. In an alternative embodiment of the present invention, the flexible arms do not include protruding segments. Yet, when inserted into the upper part 86 of the female piece 80, the flexible arms move farther apart to release the tension and lock the male piece in the female piece 80.

To disengage the fastener, the protruding segments in the middle part 82 are pressed together (e.g. by using two fingers) and the male piece 72 is pulled out of the female piece 80. In an alternative embodiment of the present invention, other common types of fasteners may be used to secure the securing harness to the infant's body.

Figure 6A:
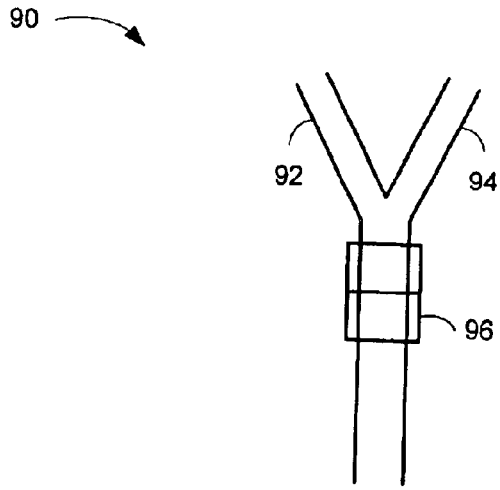
FIG. 6(*a*) shows the front side of a fastened securing harness, according to an embodiment of the present invention.
Figure 6B:
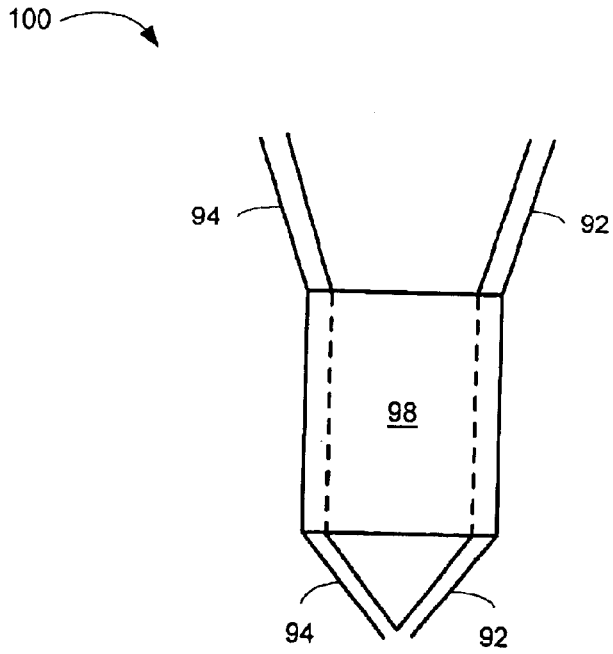

Referring now to FIG. 6(*a*), the front-side of a fastened securing harness 90 is shown to include two straps lateral harness 92 and 94 and an adjustable fastener 96, in accordance with an embodiment of the present invention. The first ends of the straps 92 and 94 pass over the shoulders of the infant (not shown in FIG. 6(*a*)) while the second ends of the straps 92 and 94 are passed between the legs of the infant. The two ends of the straps 92 and 94 are connected via the adjustable fastener 96. In one embodiment of the present invention, the adjustable fastener 96 includes a male piece and a female piece as described hereinabove.

Referring now to FIG. 6(*b*), the back-side 100 of a fastened securing harness is shown to include two lateral harness straps 92 and 94 and a Velcro surface 98, in accordance with an embodiment of the present invention. The first ends of the straps 92 and 94 pass over the shoulders of the infant (not shown in FIG. 6(*b*)) while the second ends of the straps 92 and 94 pass between the legs of the infant so that the Velcro surface 98 faces away from the infant's body. When the back of the infant is positioned on the top surface of the supporting pad, the Velcro surface 98 adheres to the Velcro patch of the supporting pad thereby securing the infant in the supine position.

Figure 7:
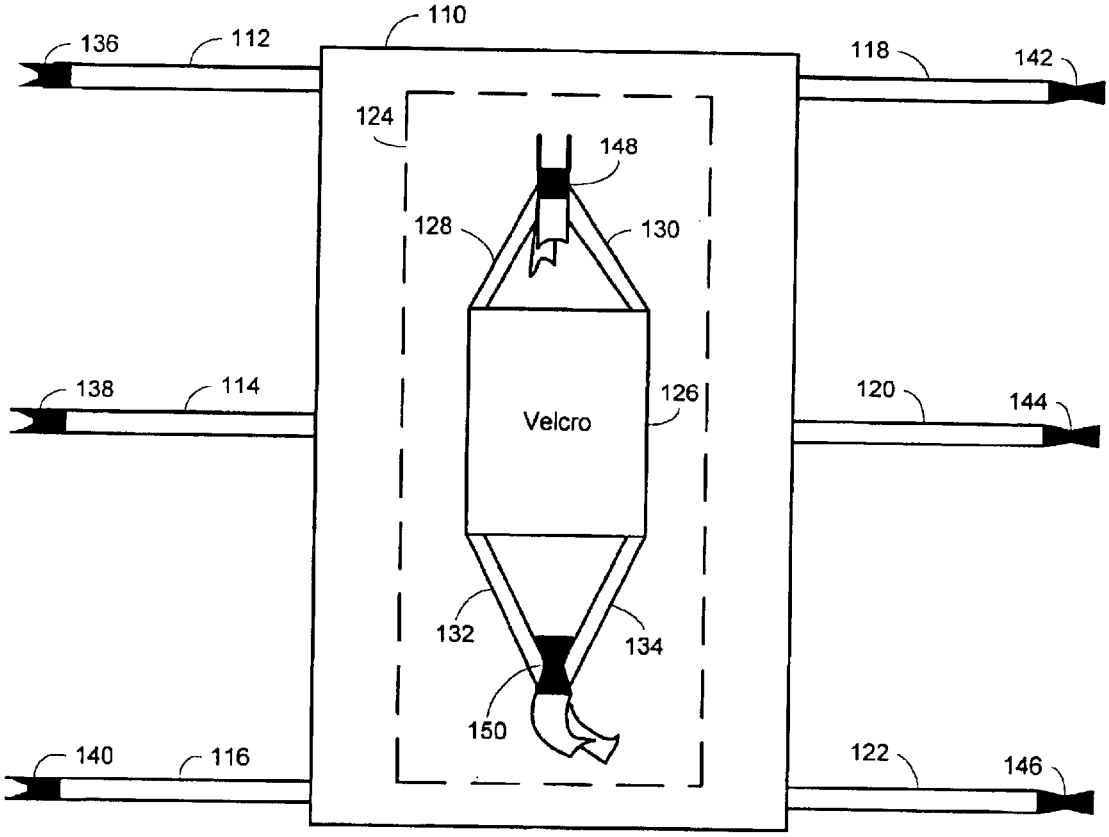
FIG. 7 shows a securing mechanism, according to an alternative embodiment of the present invention.

Referring now to FIG. 7, an alternative embodiment of the present invention is shown to include a supporting pad 110, a securing harness 124, and 6 support straps 112–122. The first ends of the support straps 112–122 are attached to the supporting pad 110. Support straps 112–122 are made from non-elastic, non-stretchable material. Each of the first ends of the support straps 112–122 is sewn to the supporting pad 110. In another embodiment of the present invention the support straps 112–122 are attached to the supporting pad 110 using other methods of attachment.

The securing harness 124 includes a securing pad 126, 2 top harness straps 128 and 130, and 2 bottom harness straps 132 and 134. The securing pad 126 is sewn to the supporting pad 110 and the top and bottom harness straps 128–134 are sewn to the securing pad 126. In another embodiment of the present invention, the securing pad 126 is attached to the supporting pad 110 and the harness straps 128–134 are attached to the securing pad 126 using other methods of attachment.

To secure the baby in the supine position, the back side of the infant is positioned on the top surface of the securing pad 126 and the top harness straps 128 and 130 are passed over the shoulders of the infant while the bottom harness straps 132 and 134 are passed between the legs of the infant. Connected to the top harness straps 128 and 130 is a male piece 148 of an adjustable fastener and connected to the bottom harness straps 132 and 134 is a female piece 150 of the same adjustable fastener. By inserting the male piece 148 into the female piece 150, on the front side of the infant, the infant is secured to the supporting pad 110 which is in turn secured to the supporting surface (not shown in FIG. 7) using the support straps 112–122. Accordingly, the infant is secured in the supine position on the supporting pad 110 using the securing harness 124.

Alternatively, the bottom harness straps 132 and 134 are passed over the shoulders and the top harness straps are passed between the legs of the infant to secure the infant in the supine position.

The top and bottom harness straps 128–134 are made from an elastic material such as a stretchable fabric. Stretching of the harness straps 128–134 allows for infants of various sizes and proportions to be secured in the supine position, as described hereinabove.

To secure the supporting pad 110 to the supporting surface, such as a crib mattress, the second ends of the support straps 112–116 are attached to male pieces 136–140, respectively, and the second ends of the support straps 118–122 are attached to the female pieces 142–146, respectively. The support straps, made from non-elastic material, are wrapped around the supporting surface and the male pieces 136–140 inserted into the female pieces 142–146 on the underside of the supporting surface in pairs to secure the supporting pad 110 to the supporting surface.

Figure 8:
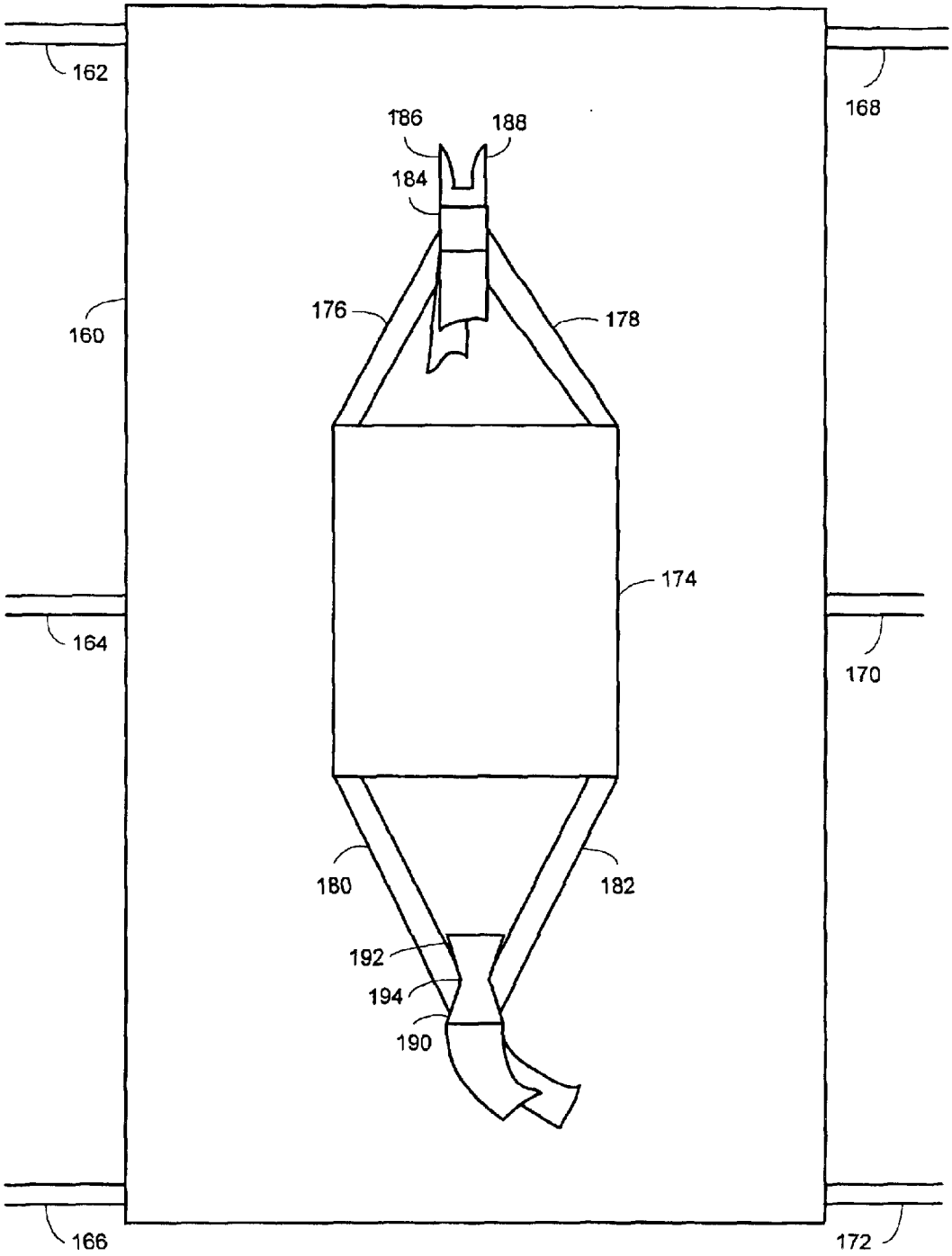
FIG. 8 shows an enlarged view of a securing mechanism, according to an alternative embodiment of the present invention.

Referring now to FIG. 8, an enlarged view of an alternative embodiment of the present invention is shown to include a supporting pad 160, a securing pad 174, 2 top harness straps 176 and 178, 2 bottom harness straps 180 and 182, and 6 support straps 162–172. The first end of each of the top harness straps 176 and 178 is attached to the securing pad 174 while the second end thereof is attached to the male piece 184. Similarly, the first end of each of the bottom harness straps 180 and 182 is attached to the securing pad 174 while the second end thereof is attached to the lower end 190 of the female piece. Each of the male and female pieces includes 2 slots therethrough the second ends of the top and bottom harness straps 178–182 are passed to secure the straps on the infant's body as described hereinabove in relation to FIG. 5.

The securing pad 174 is attached to the supporting pad 160 which is in turn secured to a supporting surface via the support straps 162–172. Specifically, the first ends of the support straps 162–172 are attached to the supporting pad 160 while the second ends of the support straps 162–172 are attached to either to a male or a female piece of an adjustable fastener, as described hereinabove in relation to FIG. 7. In an alternative embodiment of the present invention, the support straps 162–172 are attached on the first end to the supporting pad 160 while the second end of each of the support straps 162–172 is tied to the supporting structures, as described hereinabove in relation to FIG. 4.

The male piece 184 includes 2 flexible arms 186 and 188. The top and bottom harness straps are secured on the front side of the infant by pressing the 2 flexible arms 186 and 188 toward each other, e.g. using 2 fingers, and inserting the arms into the upper part 192 of the female piece. Pressing the flexible arms 186 and 188 together shortens separation thereof thereby introducing tension within the flexible arms. As the flexible arms 186 and 188 are inserted in the upper part 192 and pushed through the female piece, the arms reach the middle part 194 of the female piece. The middle part 194 has no lateral walls allowing the flexible arms 186 and 188 to release the stored tension by moving away from each other. The lateral walls of the upper and lower parts 192 and 190, respectively, prevent the flexible arms 186 and 188 from moving in or out of the female piece thereby locking the male piece inside the female piece. To disengage the adjustable fastener the flexible arms protruding from the lateral walls of the middle part 194 are pressed together, e.g. by 2 fingers, and the male piece is pulled out of the female piece.

In an alternative embodiment of the present invention, each of the flexible arms 186 and 188 has a protruding segment near the tip of the arm allowing the male piece to be locked into the female piece, as described hereinabove in relation to FIG. 5.

Figure 9:
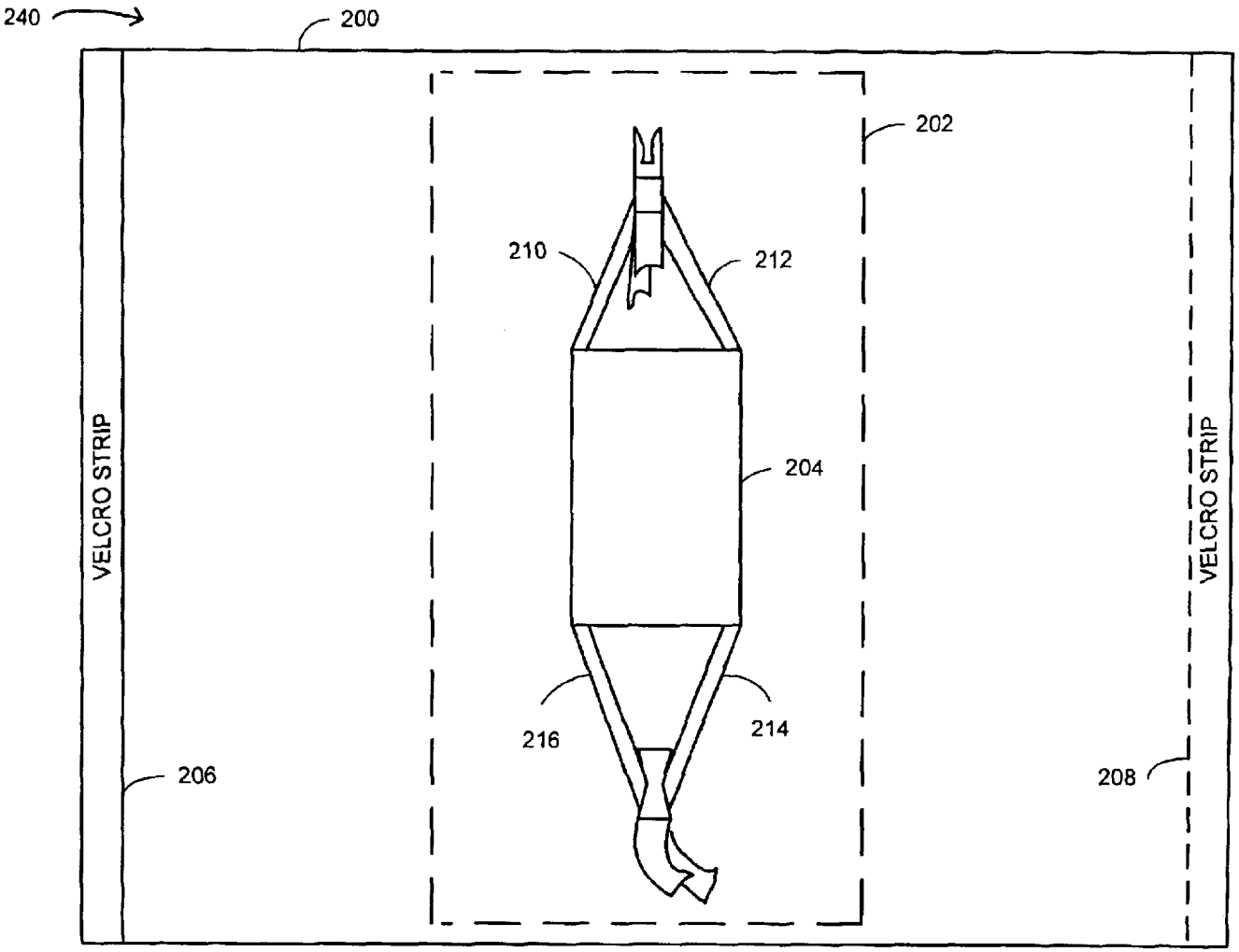
FIG. 9 shows a securing mechanism without support straps, according to an embodiment of the present invention.

Referring now to FIG. 9, an alternative embodiment of the present invention is shown to include a securing mechanism 240 without support straps. The securing mechanism 240 includes a supporting pad 200 and a securing harness 202. The securing harness 202 includes a securing pad 204 and 4 harness straps 210–216. The securing pad 204 is sewn to the supporting pad 200 and the 4 harness straps 210–216 are sewn to the securing pad 204. The supporting pad 200 further includes 2 Velcro strips 206 and 208.

In the embodiment of the present invention shown in FIG. 9, the supporting pad 200 is secured to the supporting surface, e.g. a mattress, via the Velcro strips 206–208 without using the support straps. Specifically, the Velcro patch 206 is sewn to the top surface of the supporting pad 200 while the Velcro patch 208 is sewn to the bottom surface of the supporting pad 200. The supporting pad 200 is wrapped around the mattress so that the Velcro strip 208 is positioned on the top of the Velcro strip 206 on the underside of the mattress. Accordingly, the supporting pad 200 is secured to the mattress by attaching the Velcro strip 208 to the Velcro strip 206.

Although the present invention has been described in terms of specific embodiment, it is anticipated that alterations and modifications thereof will no doubt become apparent to those more skilled in the art. It is therefore intended that the following claims be interpreted as covering all such alterations and modification as fall within the true spirit and scope of the invention.

What is claimed is:

1. A securing mechanism for securing an infant in the supine position comprising:

a supporting pad having a top surface for supporting said infant in the supine position; and a securing harness for securing said infant to said supporting pad, said securing harness being secured onto said infant's body, said securing harness including a securing pad for covering part of the back side of said infant's body, said securing pad being attached to said top surface of said supporting pad for securing said infant to said top surface of said supporting pad in the supine position wherein said securing harness further including a plurality of lateral harness straps, each of said lateral harness straps having a first end and a second end, said first ends of said lateral harness straps for passing over the shoulders of said infant, said second ends of said lateral harness straps for passing between legs of said infant, said first ends and said second ends of said lateral harness straps being connected on the front side of said infant to secure said securing harness onto said infant's body and further wherein said first ends of said lateral harness straps being connected to a male piece, said second ends of said lateral harness straps being connected to a female piece, said male piece being inserted into said female piece on the front side of said infant's body to secure said securing harness to said infant's body.

2. A securing mechanism as recited in claim 1 wherein said supporting pad including a bottom surface for being positioned on top of a supporting surface, said supporting pad being secured to said supporting surface.

3. A securing mechanism as recited in claim 2 wherein one or more support straps being attached to said supporting pad, each of said support straps having a first end and a second end, said first end of each of said support straps being attached to said supporting pad, said second ends of said support straps being connected in pairs on the underside of said supporting surface.

4. A securing mechanism as recited in claim 3 wherein said supporting surface is a crib mattress, said support straps being wrapped around said crib mattress, said second ends of said support straps being connected to secure said supporting pad to said crib mattress.

5. A securing mechanism as recited in claim 4 wherein said securing harness further including a plurality of top harness straps and a plurality of bottom harness straps, each of said top harness straps and each of said bottom harness straps having a first end and a second end, said first ends of said top harness straps and said first ends of said bottom harness straps being attached to said securing pad, said second ends of said top harness straps for passing over the shoulders of said infant, said second ends of said bottom harness straps for passing between the legs of said infant, said second ends of said top harness straps being connected to said second ends of said bottom harness straps on the front side of said infant to secure said securing harness onto said infant's body.

6. A securing mechanism as recited in claim 5 wherein said securing pad being sewn to said supporting pad, said first ends of said top harness straps and said first ends of said bottom harness straps being sewn to said securing pad.

7. A securing mechanism as recited in claim 5 wherein said supporting pad including said securing pad, said top surface of said supporting pad including said first surface of said securing pad and said bottom surface of said supporting pad including said second surface of said securing pad, said first end of each of said top harness straps and said first end of each of said bottom harness straps being attached to said supporting pad.

8. A securing mechanism as recited in claim 7 wherein said second ends of said top harness straps being connected to a male piece, said second ends of said bottom harness straps being connected to a female piece, said male piece being inserted into said female piece on the front side of said infant's body to secure said securing harness to said infant's body.

9. A securing mechanism as recited in claim 8 wherein said male piece having a first slot and a second slot, said female piece having a first slot and a second slot, said second ends of said top harness straps being passed through said first slot of said male piece, said second ends of said top harness straps folded and passes through said second slot of said male piece, said second ends of said bottom harness straps being passed through said first slot of said female piece, said second ends of said bottom harness straps being folded and passed through said second slot of and said female piece for adjusting the length of said securing harness.

10. A securing mechanism as recited in claim 5 wherein each of said top harness straps and each of said bottom harness straps being made from an elastic material, said support straps being made from a non-elastic material.

11. A securing mechanism as recited in claim 1 wherein said securing pad having a first surface and a second surface, said first surface of said securing pad for covering part of the back side of said infant's body, said second surface of said securing pad being a hook and loop fastener surface, said second surface of said securing pad facing away from said infant's body, said lateral harness straps being attached to said securing pad.

12. A securing mechanism as recited in claim 11 wherein a hook and loop fastener patch being attached to said supporting pad, said second surface of said securing pad being positioned on top of said hook and loop fastener patch to attach said second surface of said securing pad to said hook and loop fastener patch.

13. A securing mechanism as recited in claim 1 wherein said male piece having a first slot and a second slot, said female piece having a first slot and a second slot, said first ends of said lateral harness straps being passed through said first slot of said male piece, said first ends of said lateral harness straps being folded and passed through said second slot of said male piece, said second ends of said lateral harness straps being passed through said first slot of said female piece, said second ends of said lateral harness straps being folded and passed through said second slot of said female piece, said first slot and said second slot of said male piece and said female piece for adjusting the length of said securing harness.

14. A securing mechanism as recited in claim 13 wherein said male piece including an upper part, said female piece including an upper part and a middle part, said upper part of said male piece being inserted into said upper part of said female piece to lock said male piece in said female piece.

15. A securing mechanism as recited in claim 14 wherein said upper part of said male piece including two flexible arms, each of said flexible arms including a protruding segment, said protruding segments protruding out of the lateral sides of said middle part of said female piece to lock said male piece in said female piece.

16. A method and apparatus for securing an infant in the supine position comprising:

securing a securing harness onto the infant's body;

covering part of the back side of the infant's body with a first surface of a securing pad;

attaching a second surface of the securing pad to a top surface of a supporting pad;

securing the infant to the top surface of the supporting pad in the supine position passing over the shoulders of said infant, first ends of lateral harness straps:

passing between legs of said infant, second ends of lateral harness strap;

securing said harness onto said infant's body by a connection of said first ends and said second ends of said lateral harness straps onto the front side of said infant;

connecting said first ends of said lateral harness straps to a male piece, said second ends of said lateral harness straps being connected to a female piece; and inserting said male piece into said female piece on the front side of said infant's body to secure said harness to said infant's body.

* * * * *